US008915101B2

(12) United States Patent
Koizumi

(10) Patent No.: US 8,915,101 B2
(45) Date of Patent: Dec. 23, 2014

(54) WARP KNITTED FABRIC MANUFACTURING METHOD

(75) Inventor: Satoru Koizumi, Kahoku (JP)

(73) Assignees: Takenaka Seni Co., Ltd., Kahoku-shi, Ishikawa (JP); Koizumi Braid Inc., Kahoku-shi, Ishikawa (JP); Iris Co., Ltd., Ota-shi, Gunma (JP)

( * ) Notice: Subject to any disclaimer, the term of this patent is extended or adjusted under 35 U.S.C. 154(b) by 0 days.

(21) Appl. No.: 14/352,004

(22) PCT Filed: Aug. 30, 2012

(86) PCT No.: PCT/JP2012/072068

§ 371 (c)(1),
(2), (4) Date: Apr. 15, 2014

(87) PCT Pub. No.: WO2013/061686

PCT Pub. Date: May 2, 2013

(65) Prior Publication Data

US 2014/0230118 A1 Aug. 21, 2014

(30) Foreign Application Priority Data

Oct. 27, 2011 (JP) ..... 2011-235820

(51) Int. Cl.

| | |
|---|---|
| ***A41D 13/08*** | (2006.01) |
| ***D04B 21/18*** | (2006.01) |
| ***D06B 1/00*** | (2006.01) |
| ***D06C 5/00*** | (2006.01) |

(52) U.S. Cl.

CPC ..... *D04B 21/18* (2013.01); *A41D 13/08* (2013.01); *D06B 1/00* (2013.01); *D06C 5/00* (2013.01)

USPC ..... 66/193; 66/195

(58) Field of Classification Search

USPC ..... 66/172 E, 192, 193, 195; 442/314, 306

See application file for complete search history.

(56) References Cited

U.S. PATENT DOCUMENTS 2,706,898 A * 4/1955 Gross et al. ..... 66/193
2,910,853 A * 11/1959 Howard ..... 66/193

(Continued)

FOREIGN PATENT DOCUMENTS

CN 1837432 A 9/2006
EP 0 945 535 A2 9/1999

(Continued)

OTHER PUBLICATIONS

PCT, "International Search Report for International Application No. PCT/JP2012/072068".

*Primary Examiner* — Danny Worrell
(74) *Attorney, Agent, or Firm* — Manabu Kanesaka

(57) ABSTRACT

The invention addresses the problem of providing a warp knitted fabric manufacturing method capable of stably producing a warp knitted fabric wherein the longitudinal stretchability is 200%. To solve the problem, the invention is a warp knitted fabric manufacturing method that forms bands of a warp knitted structure with increased longitudinal stretchability by forming stitches with an elastic warp (2) while knitting in an elastic inserted yarn (3) in the warp direction and knitting in the weft (4) in the course direction, wherein: active feed means (30), which are obtained by placing a single follower roller (323) above two drive rollers (321, 322), are disposed on the respective paths of the warp (2) and the inserted yarn (3) to feed the warp (2) and the inserted yarn (3) to the warp knitting machine while increasing the respective elongation percentage. The active feed means (30) keep the respective feed rates of the warp (2) and the inserted yarn (3) constant while feeding same to the crochet warp knitting machine (40).

5 Claims, 6 Drawing Sheets

(56) References Cited

U.S. PATENT DOCUMENTS

| | | | | | |
|---|---|---|---|---|---|
| 3,077,758 | A | * | 2/1963 | Siciliano | 66/192 |
| 3,314,251 | A | * | 4/1967 | Bunger | 66/193 |
| 3,884,054 | A | * | 5/1975 | Niederer | 66/193 |
| 3,965,703 | A | * | 6/1976 | Barnhardt | 66/193 |
| 3,999,407 | A | * | 12/1976 | Odham | 66/193 |
| 4,003,224 | A | * | 1/1977 | Odham | 66/193 |
| 4,009,597 | A | * | 3/1977 | Wall et al. | 66/193 |
| 4,044,575 | A | * | 8/1977 | Krug | 66/192 |
| 4,103,485 | A | * | 8/1978 | Brues | 66/192 |
| 4,244,199 | A | * | 1/1981 | Rhode | 66/193 |
| 4,248,064 | A | * | 2/1981 | Odham | 66/192 |
| 4,395,889 | A | * | 8/1983 | Schnegg | 66/193 |
| 4,733,545 | A | * | 3/1988 | Weinle et al. | 66/202 |
| 4,818,316 | A | * | 4/1989 | Weinle et al. | 156/88 |
| 5,265,445 | A | * | 11/1993 | Shytles et al. | 66/192 |
| 5,522,240 | A | * | 6/1996 | Wall et al. | 66/192 |
| 5,632,526 | A | * | 5/1997 | McLarty et al. | 297/452.64 |
| 5,657,648 | A | * | 8/1997 | Ives et al. | 66/193 |
| 5,890,380 | A | * | 4/1999 | Ives et al. | 66/170 |
| 5,931,798 | A | * | 8/1999 | Green et al. | 602/6 |
| 5,963,988 | A | * | 10/1999 | Jackson, Jr. | 2/243.1 |
| 6,041,624 | A | * | 3/2000 | Pederzini | 66/193 |
| 6,079,236 | A | * | 6/2000 | Ives et al. | 66/170 |
| 6,276,177 | B1 | * | 8/2001 | West | 66/192 |
| 6,443,964 | B1 | * | 9/2002 | Ory et al. | 606/151 |
| 6,516,637 | B1 | * | 2/2003 | Fancher et al. | 66/170 |
| 6,840,066 | B2 | * | 1/2005 | Dickerson | 66/192 |
| 6,984,596 | B2 | * | 1/2006 | Dickerson | 442/316 |
| 7,201,024 | B2 | * | 4/2007 | Hirayama et al. | 66/192 |
| 7,614,258 | B2 | * | 11/2009 | Cherok et al. | 66/192 |
| 2011/0138862 | A1 | | 6/2011 | Stingel et al. | |
| 2013/0032656 | A1 | | 2/2013 | Yamamoto | |

FOREIGN PATENT DOCUMENTS

| | | | |
|---|---|---|---|
| JP | H06-033985 | U | 5/1994 |
| JP | 2718441 | B2 | 2/1998 |
| JP | H10-046454 | A | 2/1998 |
| JP | 3000444 | B2 | 1/2000 |
| JP | 2002-115156 | A | 4/2002 |
| JP | 2004-143628 | A | 5/2004 |
| JP | 2005-213662 | A | 8/2005 |

* cited by examiner

WARP KNITTED FABRIC MANUFACTURING METHOD

RELATED APPLICATIONS

The present application is National Phase of International Application No. PCT/JP2012/072068 filed Aug. 30, 2012, and claims priority from Japanese Applications No. 2011-235820, filed Oct. 27, 2011.

TECHNICAL FIELD

The present invention relates to a warp knitted fabric manufacturing method.

BACKGROUND ART

The warp knitted fabric has high longitudinal stretchability, and is generally used for a part of clothes as a reinforcement, a design accent, etc. and widely spread. Although the size of a body, particularly of a waist part, a neck part, a wrist, or an ankle varies depending on persons, it is rational that clothes with a prescribed size adapts to the variation to a certain degree. Moreover, when wearing clothes, it may be preferable that the wearing pressure is appropriate, and there is an increasing demand for a warp knitted fabric excellent in properties of high elongation and restoration (tensile elastic recovery, stretchability).

PRIOR ART DOCUMENT

Patent Document

Patent Document 1 relates to an elastic warp knitted fabric and sportswear, and describes that polyurethane elastic yarn is used so as to achieve a warp knitted fabric with elongation of 80% by Russell-knitting.

Patent Document 2 relates to a stretchable warp knitted fabric, and describes that two kinds of elastic yarn and non-elastic yarn are used for exerting power so as to achieve a stretchable warp knitted fabric by Russell-knitting.

Patent Document 3 describes a soft stretch elastic knitted fabric that is formed of polyurethane elastic yarn and non-elastic yarn and has stitches formed of the elastic yarn.

Patent Document 1: JP3000444 B1

Patent Document 2: JP2718441 B1

Patent Document 3: JP2005-213662 A1

BRIEF SUMMARY OF THE INVENTION

Problems the Invention Intends to Solve

Although the size of a wrist or an ankle varies depending on persons, it is rational that clothes with a prescribed size are made adaptive to the variation to a certain degree, as described above. However, the stretch fabric descried in Patent Documents 1 to 3 mainly aims at pressing a body, and some persons may feel pain due to oppression around a wrist or an ankle. As a method to solve this problem, it is necessary to form a warp knitted fabric that has higher elongation than a conventional one and requires small power to obtain high elongation. For example, it is considered that when a horizontal axis of a graph indicates elongation and a vertical axis of the graph indicates power, the inclination of a hysteresis loop including an elongation curve and a shrinkage curve (recovery curve) may be made small so that the elongation (elongation percentage in the longitudinal direction) becomes 200% at most. Here, the longitudinal elongation of 200% of the warp knitted fabric indicates that, with the longitudinal length of the warp knitted fabric on which no power is applied as a reference, the length of the warp knitted fabric becomes 3.0 times as long as the reference in the longitudinal direction when power is applied.

Recently, in the food industries, the electronic parts industries, etc., the demand for work clothes preventing falling of body hair is increasing. To be more specific, there is a demand for industrial production of a warp knitted fabric with a single prescribed size that is more excellent in properties of high elongation and restoration as compared with a conventional one.

The warp knitted fabric is characterized in its higher longitudinal elongation as compared with a weft knitted fabric. However, it is considered to be difficult, even with the warp knitted fabric, to industrially produce a fabric having longitudinal elongation of 200% at most. That is, the known knitting method uses a mechanism in which a warp knitting machine on the downstream side knits yarn (elastic yarn or non-elastic yarn) while drawing it from beams on the upstream side and, in general, yarn is supplied from the beams on the upstream side when tension of yarn exceeds a set value, while the supply of yarn from the beams on the upstream side is stopped when the tension of yarn becomes equal to or smaller than the set value. When non-elastic yarn is used, it is relatively easy to stably supply it because the yarn is not elongated or shrunk. However, when elastic yarn is used, the yarn is knitted while repeating its elongation and shrinkage, which increases variation in elongation and shrinkage of the knitted elastic yarn. Moreover, in the nature of rubber, the behavior of elongation and shrinkage of the elastic yarn is slow motion, and the supply of the yarn and the stop thereof cannot be performed quickly, thus generating a time lag. Therefore, the elastic yarn cannot be fed stably with a constant tension. Furthermore, due to the time lag, when the operation speed of the warp knitting machine is increased, the elastic yarn may be broken depending on a case.

Therefore, the object of the present invention is to provide, regarding a warp to knitted fabric, a warp knitted fabric manufacturing method capable of stably producing a fabric having longitudinal elongation of 200%, a warp knitted fabric and work clothes having longitudinal elongation of 200% at most.

Means for Solving the Problems

The warp knitted fabric manufacturing method of the present invention is a warp knitted fabric manufacturing method for forming warp knitted texture having higher longitudinal elongation by knitting stretchable inserting yarn in a warp direction and knitting weft yarn in a course direction while forming stitches with stretchable warp yarn, and is characterized in that active feed means, which are constituted by a single follower roller arranged above two drive rollers, are arranged on each of paths for the warp yarn and the inserting yarn to feed the warp yarn and the inserting yarn to a warp knitting machine while increasing the elongation thereof, so that the active feed means feed the warp yarn and the inserting yarn to the warp knitting machine while keeping the feed amounts thereof constant.

According to the present invention, active feed means, which are constituted by a single follower roller arranged above two drive rollers, are arranged on each of paths for the warp yarn and the inserting yarn, and the active feed means feed the warp yarn and the inserting yarn to the warp knitting machine while keeping the feed amounts thereof constant. Thus, it is possible to stably feed the elastic yarn with a constant tension and form band-form warp knitted texture having higher longitudinal elongation.

The active feed means are preferably arranged at a position close to the warp knitting machine. This makes it easier to feed the elastic yarn to the warp knitting machine in the state where the tension applied on the elastic yarn is high. The active feed means may be operated asynchronously with the warp knitting machine, or may be operated synchronously with the warp knitting machine.

The active feed means are constituted by a single follower roller arranged at a position above a position between two drive rollers arranged with an interval. These drive rollers have a configuration in which they rotate synchronously by a single electric motor through a power transmission mechanism, a configuration in which they rotate synchronously by two electric motors through power transmission mechanisms, etc. As the electric motor, an electric motor provided in the warp knitting machine may be used, or an individual electric motor may be provided separately. The power transmission mechanism includes a chain drive mechanism, a gear drive mechanism, a belt drive mechanism, etc. The elastic yarn is extended among the drive rollers and the follower roller, and the follower roller rotates synchronously with the drive rollers. For example, the drive roller is made of stainless steel, steel, or ceramics, etc. to actively feed the elastic yarn and increase abrasion resistance. The follower roller is made of rubber to increase frictional resistance. The active feed means are also referred to as a tree-point roller because of the arrangement configuration.

The warp knitting machine includes a crochet machine, a Raschel machine, a tricot machine, etc.

The present invention is characterized in that a crochet warp knitting machine is used as the warp knitting machine, and tension control means for controlling the tension applied on the warp yarn and the inserting yarn not to exceed upper limits thereof are arranged on the upstream side of the active feed means so that the warp yarn and the inserting yarn are fed to the active feed means while the tension control means keep the tension on the warp yarn and the inserting yarn in a certain range.

According to the present invention, the crochet warp knitting machine is used as the warp knitting machine, which makes it easier to apply high tension on the inserting yarn as compared with the Raschel machine and the tricot machine. Moreover, the tension control means of controlling the tension applied on the warp yarn and the inserting yarn not to exceed upper limits thereof are arranged on the upstream side of the active feed means respectively, so that the warp yarn and the inserting yarn are fed to the active feed means while the tension control means keep the tension on the warp yarn and the inserting yarn in a certain range. This makes it easier to stabilize the tension on the warp yarn and the inserting yarn. The tension control means are preferably arranged at a position apart from the active feed means. The variation of tension on the elastic yarn becomes further smaller.

The tension control means have a control mechanism that performs control using the principle of leverage (or principle of a balancing toy). For example, the tension control means are constituted by a control frame having yarn feed rollers, a limit switch, and an electric yarn feed roller, and have an arrangement configuration of moving upward and downward like a seesaw (or a balancing toy) due to external force (tension). As a more specific example, when the roller on the front end side of the control frame moves upward as the elastic yarn is tensioned and the tension increases, the limit switch is turned on at the upper limit of such tension, which rotates the electric yarn feed roller and thus supplies the elastic yarn. When the elastic yarn is loosened and the tension thereof is reduced, the roller on the front end side of the control frame moves downward, and the limit switch is turned off at the lower limit of the tension of the elastic yarn. This stops the electric yarn feed roller and thus stops supply of the elastic yarn.

Stretchable (elastic) yarn is applied as the warp yarn and the inserting yarn. The elastic yarn includes stretchable yarn made of polyurethane, latex, elastomer, natural rubber, etc., yarn obtained by compounding them, yarn obtained by twisting them, etc. Non-elastic yarn is applied as the weft yarn, but elastic yarn may be also applied. The non-elastic yarn includes non-stretchable yarn made of rayon, polyester, nylon, acryl, natural fiber, etc., yarn obtained by compounding them, yarn obtained by twisting them, etc.

In the present invention, it is preferable to use polyurethane elastic yarn as the warp yarn and the inserting yarn, set the elongation of the warp yarn and the inserting yarn to be 200% or higher but lower than 500%, and set the elongation of the inserting yarn to be higher than the elongation of the warp yarn.

According to the present invention, polyurethane elastic yarn is used as the warp yarn and the inserting yarn, and the elongation of the warp yarn and the inserting yarn is set to be 200% or higher but lower than 500%. In addition, the elongation of the inserting yarn is set to be higher than the elongation of the warp yarn. In this manner, when power for longitudinal elongation of 50% is N1 and power for longitudinal elongation of 150% is N2, there is obtained warp knitted texture allowing N2 to be smaller than three times as much as N1. Thus, it is possible to easily form a warp knitted fabric that requires small power to obtain high elongation.

The present invention is characterized in that after the warp knitted texture is formed, water immersion, steam heating, washing, and drying are performed, and then the knitted texture is heated and thermally shrunk while being pressed in the longitudinal direction with given intervals.

According to the present invention, after the warp knitted texture is formed, water immersion, steam heating, washing, and drying are performed, and then the warp knitted texture is heated and thermally shrunk while being pressed in the longitudinal to direction with given intervals. In this manner, it is possible to easily form a warp knitted fabric that has higher elongation and requires smaller power to obtain high elongation as compared with a conventional one.

The warp knitted fabric of the present invention has band-form warp knitted texture formed by knitting stretchable inserting yarn in a warp direction and weft yarn in a course direction while forming stitches with stretchable warp yarn, and is characterized in that the warp yarn and the inserting yarn are elastic yarn made of any of polyurethane, latex, elastomer, and natural rubber, or by compounding two or more kinds of them, and are knitted by a crochet warp knitting machine with the elongation of the warp yarn and the inserting yarn set to be 200% or higher but lower than 500%, and when power for longitudinal elongation of 50% is N1 and power for longitudinal direction of 150% is N2, N2 is smaller than three times as much as N1.

According to the present invention, a single prescribed size can cover a length in a range of 1 to 2.5 times and the pressure on a body is small. This allows a warp knitted fabric having higher elongation as compared with a conventional one and thus clothes easy to wear and comfortable to wear.

The work clothes of the present invention is characterized in that the warp knitted fabric of the present invention described above is used for any one of a cuff and a bottom opening or both of them so that the longitudinal direction of the warp knitted fabric corresponds to a peripheral direction.

According to the present invention, a single prescribed size can cover a peripheral length of a wrist or an ankle in a range of 1 to 2.5 times and the pressure on a body is small. This prevents falling of body hair and reduces pain due to oppression around a wrist or an ankle. Even when the strength of legs, a waist, and arms is weak, the work clothes are easy to wear and comfortable to wear.

Effects of the Invention

According to the present invention, active feed means, which are constituted by a single follower roller arranged above two drive rollers, are arranged on each of paths for the warp yarn and the inserting yarn, and the active feed means feed the warp yarn and the inserting yarn to the warp knitting machine while keeping the feed amounts thereof constant. Thus, it is possible to stably feed the elastic yarn with a constant tension and form band-form warp knitted texture having higher longitudinal elongation. Moreover, according to the present invention, the crochet warp knitting machine is used, and the tension control means are arranged on the upstream side of the active feed means, which makes it easier to stabilize the tension on the warp yarn and the inserting yarn.

Regarding the work clothes made of the warp knitted fabric of the present invention, a single prescribed size can cover a peripheral length of a wrist or an ankle in a range of 1 to 2.5 times and the pressure on a body is small. This prevents falling of body hair and reduces pain due to oppression around a wrist or an ankle. Even when the strength of legs, a waist, and arms is weak, the work clothes are easy to wear and comfortable to wear.

MODE FOR CARRYING OUT THE INVENTION

Hereinafter, specific modes for carrying out the present invention will be explained by using drawings.

(Warp Knitted Fabric)

Figure 7:
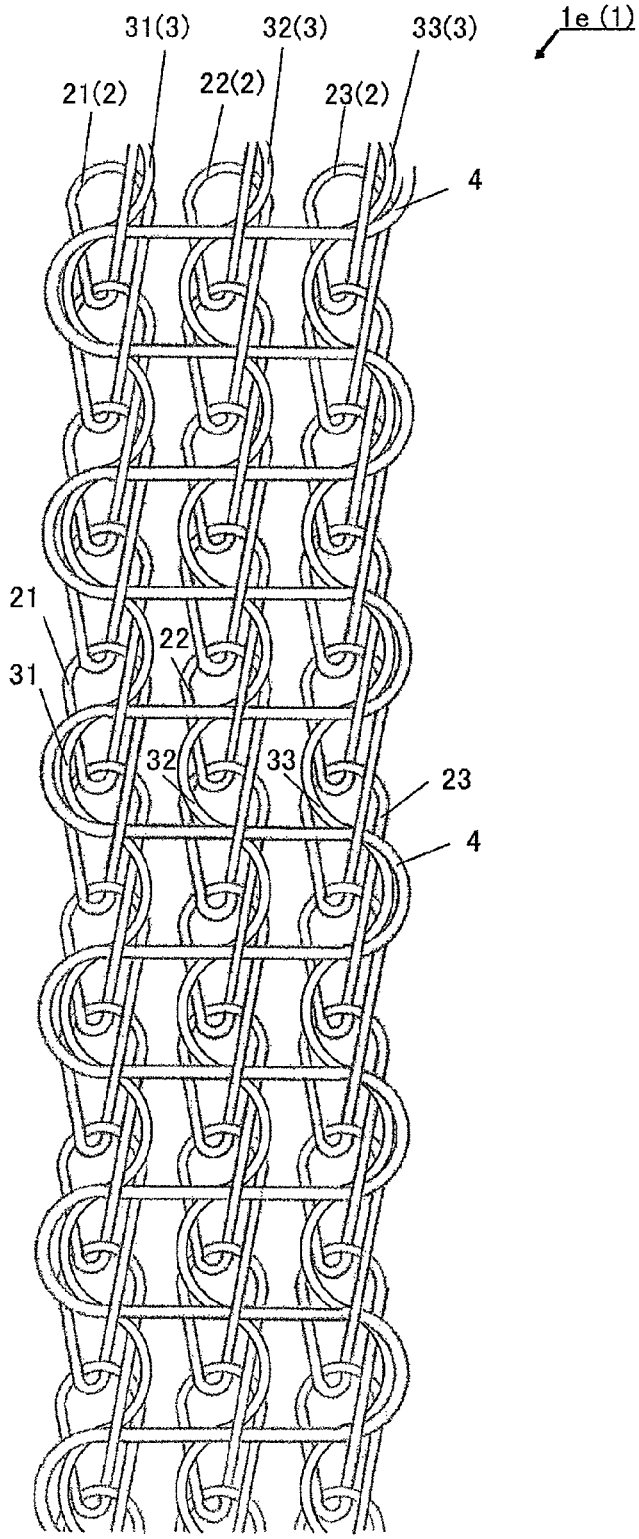
FIG. 7 is a texture diagram exemplifying knitted texture of the warp knitted fabric according to the embodiment of the present invention.

FIG. 7 is a texture diagram exemplifying knitted texture of a warp knitted fabric 1*e* (1) to which the present invention is applied. The warp knitted fabric 1 of the embodiment is a band-form tape fabric, and has high stretchability in the longitudinal direction and non-stretchability in the width direction. A symbol 2 (21, 22, 23) represents stretchable warp yarn forming stitches, a symbol 3 (31, 32, 33) represents stretchable inserting yarn knitted in a warp direction, and a symbol 4 represents weft yarn knitted in a course direction. These kinds of yarn form the band-form warp knitted texture. Here, the warp yarn 2 and the inserting yarn 3 are stretchable yarn. To be more specific, they are elastic yarn using any of polyurethane, latex, elastomer, and natural rubber, or any two or more kinds of them. The weft yarn 4 is non-elastic yarn, and rayon, polyester, nylon, acryl, natural fiber, etc., are used, for example. Then, the warp yarn 2 and the inserting yarn 3 are knitted by a crochet warp knitting machine with the elongation of the warp yarn 2 and the inserting yarn 3 set to be 200% or higher but lower than 500%. In this manner, the stretchability of the tape fabric 1 in the longitudinal direction becomes equal, thus achieving the warp knitted fabric 1 hardly having fray and high in stretchability.

(Warp Knitted Fabric Manufacturing Method)

Figure 6:
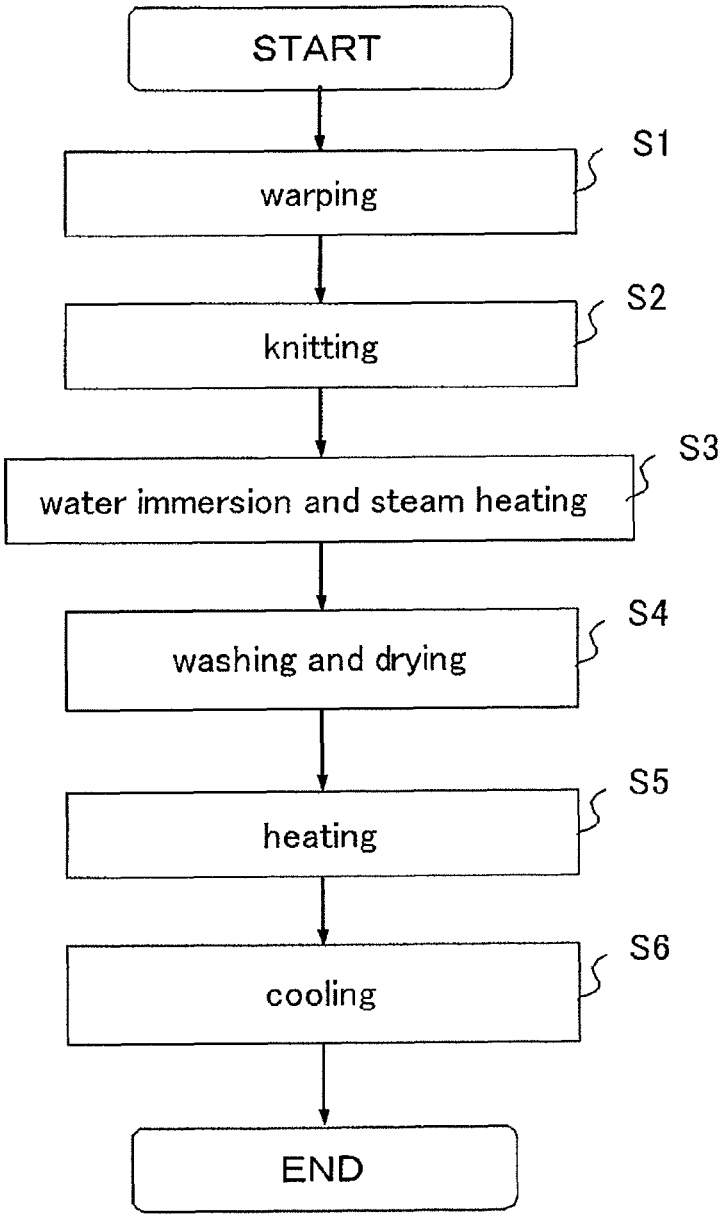
FIG. 6 is a flow chart diagram exemplifying a manufacturing procedure of the warp knitted fabric according to the embodiment of the present invention.

FIG. 6 is a flow chart diagram exemplifying a manufacturing procedure of the warp knitted fabric 1 of the embodiment of the present invention. The manufacturing procedure of the warp knitted fabric 1 of the embodiment includes processes of warping (symbol S1), knitting (symbol S2), water immersion and steam heating (symbol S3), washing and drying (symbol S4), heating (symbol S5), and cooling (symbol S6) (FIG. 6). The manufacturing procedure will be described in the following based on the flowchart illustrated in FIG. 6.

The warping (symbol S1) is a knitting preparation process, in which regarding each of the weft yarn 2 and the inserting yarn 3, side yarn is wound in the state where the elastic yarn as core yarn is elongated. The standard setting of elongation when covering is performed is 350% to 450% in the warp yarn 2, and 400% to 600% in the inserting yarn. The standard yarn count (thickness) of the warp yarn 2 to be used is 20 to 40 deniers in the core yarn, and 30 to 100 deniers in the side yarn. Moreover, the standard yarn count (thickness) of the inserting yarn 3 to be used is 140 to 1680 deniers in the core yarn, and 30 to 300 deniers in the side yarn. It should be noted that the yarn on which covering has been performed may be purchased and, depending on a use, covering may not be performed. Next, beam warping for collecting a plurality of yarn and winding them around a beam is performed to reduce variation in a supply amount of the yarn.

Figure 1:
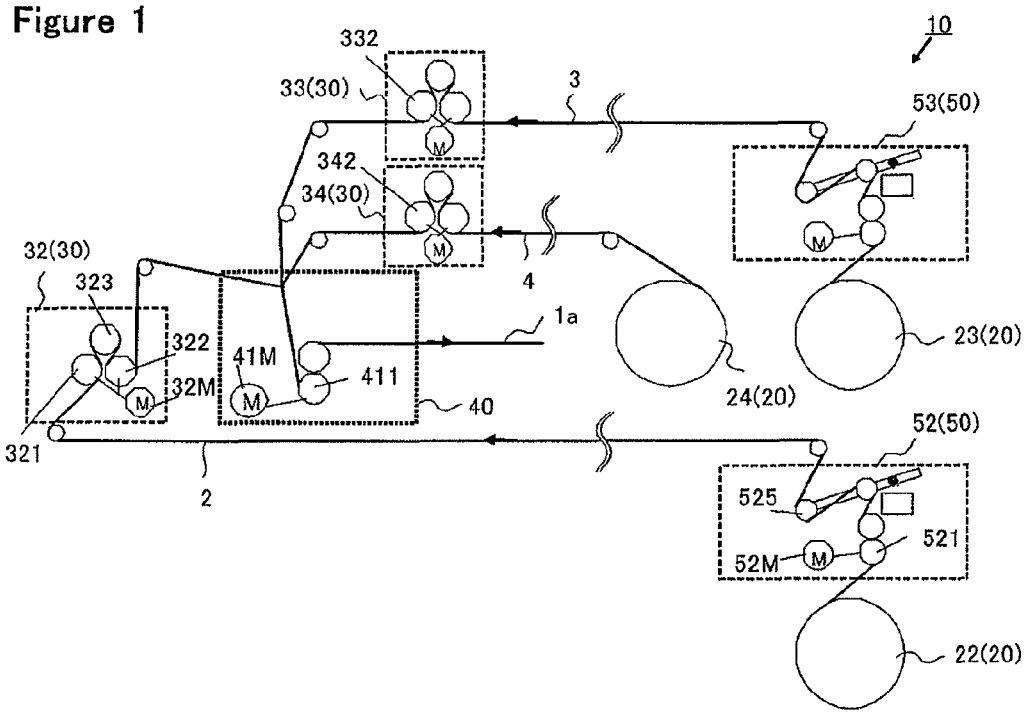
FIG. 1 is a diagram functionally illustrating a knitting process of a warp knitted fabric according to an embodiment of the present invention.

FIG. 1 is a diagram functionally illustrating the knitting process (knitting device 10) (symbol S2) of the warp knitted fabric 1 of the embodiment. The knitting device 10 of the embodiment has a configuration in which yarn supplied from beams 20 arranged on the upstream side is knitted by a warp knitting machine 40 arranged on the downstream side (FIG. 1).

In the embodiment, a crochet warp knitting machine is used as the warp knitting machine 40. It is because the use of the crochet warp knitting machine makes it easier to apply high tension on the inserting yarn.

In order to feed the warp yarn 2 and the inserting yarn 3 to the warp knitting machine 40 while increasing the elongation thereof respectively, the embodiment has a configuration in which active feed means 30 are arranged on each of paths for the warp yarn 2 and the inserting yarn 3, so that the active feed means 30 feed the warp yarn 2 and the inserting yarn 3 to the warp knitting machine 40 while keeping the feed amounts thereof constant. The active feed means 30 are arranged on the upstream side near the warp knitting machine 40 to make it easier to deliver the warp yarn 2 and the inserting yarn 3 to the warp knitting machine 40 in the state where the tension applied on the warp yarn 2 and the inserting yarn 3 is high.

Figure 2:
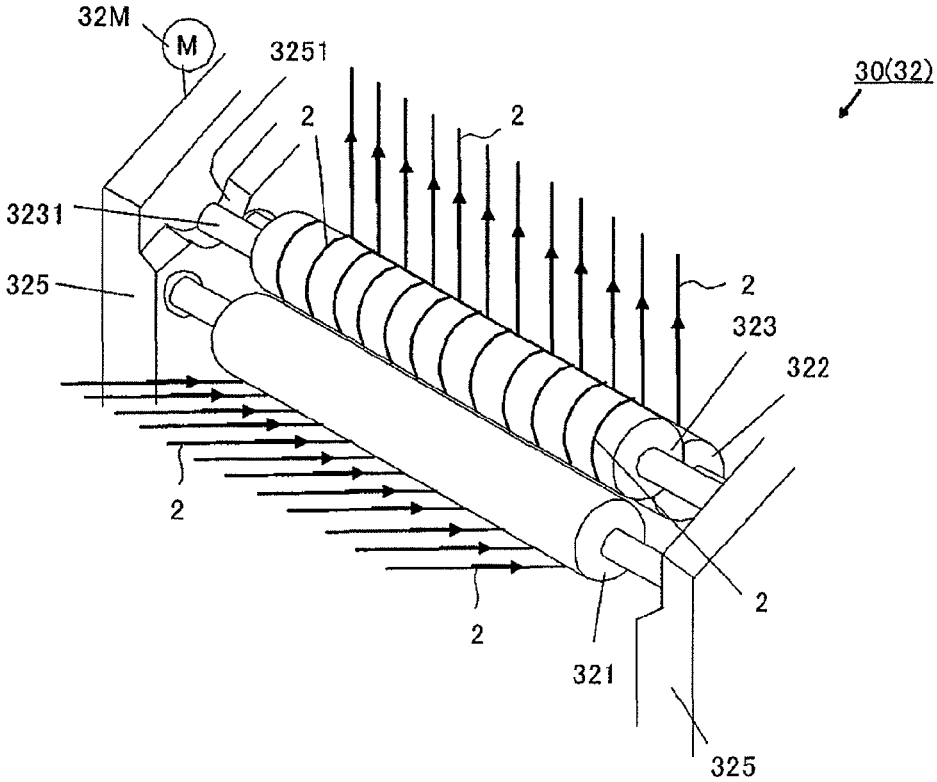
FIG. 2 is a perspective view illustrating the active feed means in the knitting process of the embodiment.

FIG. 2 is a perspective view illustrating the active feed means 30 (32). The active feed means 32 have a configuration in which a follower roller 323 is arranged just above an intermediate point between a drive roller 321 on the upstream side and a drive roller 322 on the downstream side. The drive rollers 321, 322 have a configuration in which they rotate synchronously by an electric motor 32M through a to power transmission mechanism such as a chain drive mechanism. The drive rollers 321, 322 are attached between side walls of erected frames 325, 323 through bearings, etc. so that they can rotate freely. The positions of the drive rollers 321, 322 are fixed. On the other hand, an axis 3231 of the follower roller 323 is placed on hollows 3251 formed on inner side walls of the erected frames 325, 323, and can rotate freely and swing freely. Here, the follower roller 323 is not directly in contact with the drive rollers 321, 322. However, the warp yarn 2 (or the inserting yarn 3) is extended among the drive rollers 321, 322 and the follower roller 323, and high tension is applied on the elastic yarn 2, whereby the follower roller 323 rotates in synchronization with the drive rollers 321, 322. For example, the drive rollers 321, 322 are made of stainless steel, steel, ceramics, etc. to actively feed the elastic yarn 2, 3 and increase abrasion resistance. The follower roller 323 is made of rubber to increase frictional resistance. The active feed means 30 may be operated asynchronously with the warp knitting machine 40, or operated synchronously therewith. A symbol 41M represents an electric motor that drives a fabric winding roller 411 in the warp knitting machine 40. It should be noted that the configuration of the embodiment is not limited to the one described above, and may be a configuration in which the follower roller 323 is in contact with the drive rollers 321, 322.

According to the present embodiment, the active feed means 30 are arranged on each of the paths for the warp yarn 2 and the inserting yarn 3, and these active feed means 30 feed the warp yarn 2 and the inserting yarn 3 to the warp knitting machine 40 while keeping the feed amounts thereof constant. Thus, it is possible to stably feed such elastic yarn 2, 3 with a constant tension and form band-form warp knitted texture having higher longitudinal elongation.

To obtain the warp knitted fabric 1 of the embodiment, the speed ratio between the drive rollers 322, 332, 342 and the fabric winding roller 411 in the crochet warp knitting machine 40 that are illustrated in FIG. 1 is generally set as follows. That is, when the yarn feeding speed of the fabric winding roller 411 is set to be 1 as a reference value, the speed of the drive roller 322 for the warp yarn 2 is set to be 4 to 5 times as high as the reference value, and the speed of the drive roller 332 for the inserting yarn 3 is set to be 0.2 to 0.3 times as high as the reference value. This exerts the effect in which the warp yarn holds the constituting weft yarn and inserting yarn when the warp knitted fabric 1 is in the non-elongated state, whereby it is possible to expect reduction of yarn escape and deformation of the warp knitted fabric in repeated elongation and shrinkage. It should be noted that the speed of the drive roller 342 for the weft yarn 4 is appropriately set depending on a swing width (use amount) of the weft yarn of individual knitted texture.

To obtain the warp knitted fabric 1 of the embodiment, the elongation of the warp yarn 2 and the inserting yarn 3 is set to be 200% or higher but lower than 500%, and the elongation of the inserting yarn is set to be higher than the elongation of the warp yarn.

In the embodiment, tension control means 50 of controlling such that the tension applied on the warp yarn 2 and the inserting yarn 3 does not exceed the upper limits thereof are arranged on the side near the beams 20 on the upstream side of the active feed means 30. In order to reduce variation of the tension applied on the elastic yarn 2, 3 as much as possible, the tension control means 50 are arranged at positions apart from the active feed means 30, and arranged at positions 3 m to 5 m apart from the active feed means 30 in the example illustrated in FIG. 1.

Figure 3A:
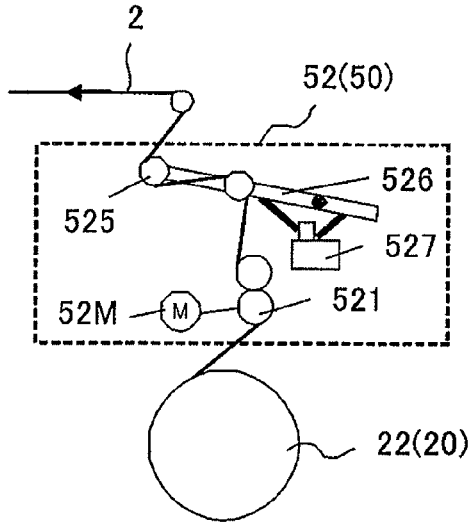
FIG. 3A is a diagram illustrating the tension control unit in the knitting process of the embodiment, when the tension is high.
Figure 3B:
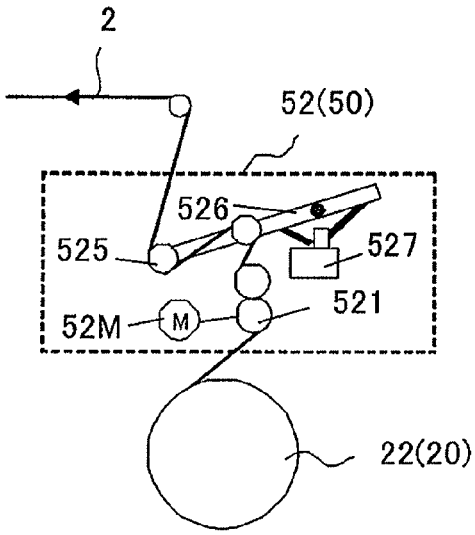
FIG. 3B is a diagram illustrating the tension control unit in the knitting process of the embodiment, when the tension is low.

FIG. 3A and FIG. 3B are diagrams exemplifying the tension control means 50. The tension control means 50 are constituted by a control frame 526 including yarn feed rollers 525, a limit switch 527, and an electric yarn feed roller 521. A symbol 52M represents an electric motor. The tension control means 50 have an arrangement configuration of moving upward and downward like a seesaw (or a balancing toy) due to external force (tension). The tension control means 50 control the electric yarn feed controller 521 in the manner such that the control frame 526 including the yarn feed rollers 525 acts like a balancing toy, thus turning on/off the limit switch 527. That is, when the roller 525 on the front end side of the control frame moves upward as the elastic yarn 2 is tensioned and the tension increases, the limit switch 527 is turned on at the upper limit of such tension (FIG. 3A), and the electric motor 52M is driven, which rotates the electric yarn feed roller 521 and thus supplies the elastic yarn 2. When the elastic yarn 2 is loosened and the tension thereof is reduced, the roller 525 on the front end side of the control frame moves downward, and the limit switch 527 is turned off at the lower limit of the tension of the elastic yarn 2, so that the electric motor 52M is stopped. This stops the electric yarn feed roller 521 and thus stops supply of the elastic yarn 2 (FIG. 3B). The upper limit and the lower limit of tension of the elastic yarn 2 can be adjusted depending on positions at which the to limit switch 527 is turned on/off. It is also possible to adjust the upper limit and the lower limit of tension of the elastic yarn 2 by adding a weight on the front end side or the rear end side of the control frame 526.

According to the embodiment, the tension control means 50 feed the warp yarn 2 and the inserting yarn 3 to the active feed means 30 while keeping the tension on the warp yarn 2 and the inserting yarn 3 in a certain range, which makes it easier to stabilize the tension on the warp yarn 2 and inserting yarn 3. It should be noted that the tension control means 50 only need to have the configuration in which the limit switch 527 is turned on at the upper limit of tension of the elastic yarn 2, which rotates the electric yarn feed roller 521 and thus supplies the elastic yarn 2, and the limit switch 527 is turned off at the lower limit of tension of the elastic yarn 2, which stops the electric yarn feed roller 521 and thus stops supply of the elastic yarn 2, and the tension control means 50 are not limited to the above-described embodiment.

Figure 4:
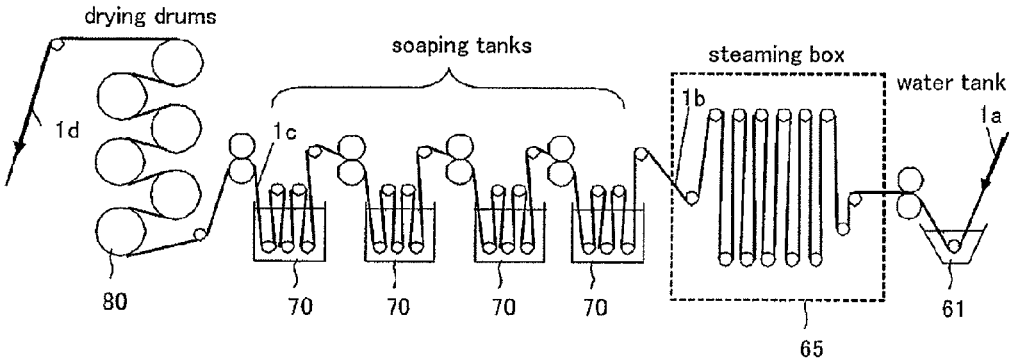
FIG. 4 is a diagram functionally illustrating processes of water immersion, steam heating, washing, and drying of the warp knitted fabric according to the embodiment of the present invention.
Figure 5:
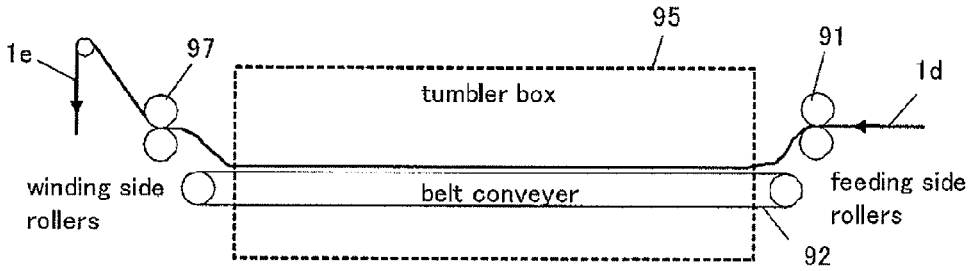
FIG. 5 is a diagram functionally illustrating a heating process of the warp knitted fabric according to the embodiment of the present invention.

FIG. 4 is a diagram functionally illustrating the water immersion and steam heating (symbol S3) and the following process of washing and drying (symbol S4) of the warp knitted fabric 1 of the embodiment. A warp knitted fabric 1*a* knitted in the knitting process (symbol S2) described above is subjected to water immersion in a water tank 61, and steamed by high-temperature steam in a steaming box 65 to be thermally shrunk, whereby a warp knitted fabric 1*b* is obtained (symbol S3). A water temperature in the water tank 61 is a room temperature of 10 to 30° C. A temperature of high-temperature steam in the steaming box 65 is 104 to 106° C. Here, when the water in the water tank 61 is substituted by dyeing liquid, the dyed warp knitted fabric 1 can be obtained in the same process as above.

The warp knitted fabric 1*b* subjected to the water immersion and steam heating by steam heat (symbol S3) is immersed in washing liquid in a plurality of soaping tanks 70 to be a warp knitted fabric 1*c*, and dried in a drying drum 80 to be a warp knitted fabric 1*d* (symbol S4). The soaping is a process for washing oil and stains adhered on the yarn forming the warp knitted fabric 1*b* with the use of known washing liquid, and the temperature of such washing liquid is 40 to 60° C. Then the washed warp knitted fabric 1*c* is dried in the drying drums 80 at a drying temperature of 100 to 120° C. to be the warp knitted fabric 1*d*. The temperature conditions described above are an example for the case in which the elastic yarn 2, 3 is polyurethane yarn, and the temperature conditions are not limited to the ones described above. However, to it is necessary to control such that the temperature does not increase to a temperature area in which any of the yarn forming the warp knitted fabric 1 exhibits thermoplasticity. This is for avoiding obstruction when the fabric is further shrunk in the following heating process.

The warp knitted fabric 1*d* washed and dried in the above-described washing and drying processes (symbol S4) is thermally shrunk in a tumbler box 95 (symbol S5), and cooled naturally or cooled forcedly by a blowing fan, etc. to be a warp knitted fabric 1*e* (symbol S6). The tumbler box 95 is tunnel formed, and a belt conveyer 92 provided with a heating heater is arranged. Feeding side rollers 91 are arranged on the entrance side of the tumbler box 95, and winding side rollers 97 are arranged on the exit side of the tumbler box 95. The warp knitted fabric 1*d* is held by the feeding side rollers 91 and the winding side rollers 97 in the state where the tension is nearly zero, and fed while being heated by the belt conveyer 92. That is, the warp knitted fabric 1*d* is thermally shrunk while keeping the state loosened to a certain degree, and becomes a warp knitted fabric 1*e*. A heating temperature of the belt conveyer 92 is 190 to 195° C., and heating time is 60 to 90 seconds. The above-described temperature condition is an example for the case in which the elastic yarn 2, 3 is polyurethane yarn, and the temperature condition is not limited to the one described above. However, the temperature is increased to a temperature area or an area close thereto in which any of the yarn forming the warp knitted fabric 1 exhibits thermoplasticity, whereby the yarn is hardly frayed. Here, for example, the rotation speed of the winding side rollers 97 is reduced relative to the rotation speed of the feeding side rollers 91 so that the tension applied on the warp knitted fabric 1*d* is zero, and the rotation speed of the winding side rollers 97 is adjusted to the degree that the looseness of the warp knitted fabric 1*d* is not significant. The completed warp knitted fabric 1*e* is wound or cut with a given length to be a part of clothes.

EXAMPLE

Polyurethane yarn available in the market was used for the warp yarn 2 and the inserting yarn 3, and polyester yarn available in the market was used for the weft yarn 4, so as to manufacture the warp knitted fabric 1. With respect to a product of the present invention and a convention product formed of a yarn material same as the present invention, power test was performed when they are elongated and shrunk. The power test was performed in Takamatsu testing branch of Japan Textile Products Quality and Technology Center. As the test method, a certain speed elongation tensile testing machine was used, and the tensile speed was set to be 30 cm/minute for all the width with the grip interval of 10 cm. The result is shown in the following table 1.

TABLE 1

| | Invention product (embodiment) | | Conventional product (Prior Art) | |
|---|---|---|---|---|
| elongation (%) | required power elongated state (N) | required power shrunk state ( N) | required power elongated state (N) | required power shrunk state (N) |
| 10 | 3.16 | 0.00 | 2.98 | 1.06 |
| 20 | 4.74 | 1.88 | 4.89 | 2.63 |
| 30 | 5.89 | 3.30 | 6.83 | 4.04 |
| 40 | 6.93 | 4.42 | 9.12 | 5.43 |
| 50 | 7.96 | 5.38 | 11.94 | 7.01 |
| 60 | 9.01 | 6.16 | 15.45 | 9.19 |
| 70 | 10.06 | 6.92 | 20.08 | 12.62 |
| 80 | 11.18 | 7.67 | 26.32 | 18.48 |
| 90 | 12.30 | 8.39 | 35.36 | |
| 100 | 13.54 | 9.22 | | |
| 110 | 14.78 | 9.97 | | |
| 120 | 16.15 | 10.86 | | |
| 130 | 17.56 | 11.82 | | |
| 140 | 18.97 | 12.95 | | |
| 150 | 20.44 | 14.29 | | |
| 160 | 21.94 | 15.78 | | |
| 170 | 23.51 | 17.66 | | |
| 180 | 25.12 | 19.96 | | |
| 190 | 26.75 | 23.18 | | |
| 200 | 28.56 | | | |

According to Table 1, the product of the present invention is a warp knitted fabric having higher stretchability than a conventional product. For example, the required power in the elongated state when the elongation is 80% is 26.32 [N] in the conventional product, and 11.18 [N] in the product of the present invention, which requires the half or lower power. When the product of the present invention is elongated with power same as the power in the conventional product, the elongation of the conventional product is 80%, while the elongation of the product of the present invention is 190%. It was shown that the product of the present invention was elongated twice or more with same power.

Figure 9:
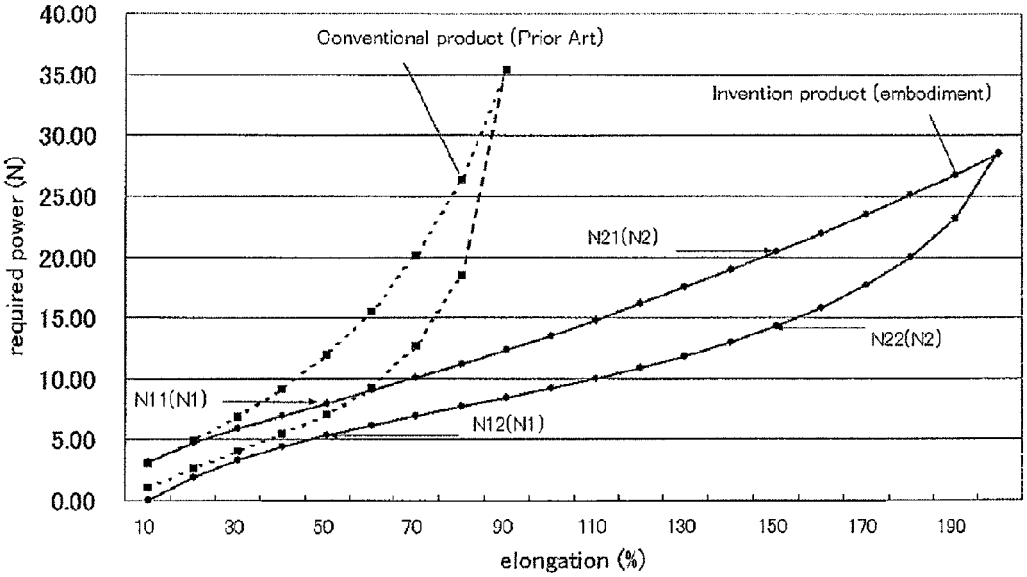
FIG. 9 is a graph diagram illustrating the relation between elongation and power to of the warp knitted fabric by comparison between a product of the present invention and a conventional product.

FIG. 9 is a graph diagram illustrating the relation between elongation and power of warp knitted fabrics by comparison between the product of the present invention and the conventional product illustrated in Table 1. The horizontal axis of the graph indicates elongation [%], and the vertical axis of the graph indicates power [N]. Regarding the hysteresis loop in the graph, the line on the upper side, relative to a peak point as a border, is an elongation curve, and the line on the lower side is a shrinkage curve (recovery curve).

According to Table 1 and FIG. 9, in the product of the present invention, the power is 6.93 [N] when the elongation (elongation percentage in the longitudinal direction) is 40%, and the power is 11.18 [N] when the elongation is 80%. Thus, the power required to double the elongation is approximately as small as 1.6 times. However, in the conventional product, the power is 9.12 [N] when the elongation (elongation percentage in the longitudinal direction) is 40%, and the power is 26.32 [N] when the elongation is 80%. Thus, the power required to double the elongation is approximately as much as 2.9 times. Moreover, the product of the present invention is knitted by the crochet warp knitting machine with the elongation of the warp yarn and the inserting yarn set to be 200% or higher but lower than 500%, and the power is 7.96 [N] when the elongation (elongation percentage in the longitudinal direction) is 50%, and the power is 20.44 [N] when the elongation is 150%. Thus, the required power is about 2.6 times while the elongation is three times. That is, when the power when the elongation (elongation percentage in the longitudinal direction) is 50% is N1, and the power when the elongation is 150% is N2, N2 is smaller than three times as much as N1. In the example (the product of the present invention), the inclination of the hysteresis loop is smaller as compared with the comparative example (the conventional product). Moreover, the power required when the elongation of the product of the present invention is 200% is 28.56 [N], while the power required when the elongation of the conventional product is 90% is 35.36 N. Thus, it is possible to consider that the product of the present invention requires smaller power than the conventional product also with respect to the power required to maximize the elongation. Therefore, when the product of the present invention is stretched with power of 35 [N], for example, the elongation of the product of the present invention exceeds 200%. According to the present invention, regarding a warp knitted fabric, it is possible to stably produce the fabric having longitudinal elongation of 200% or higher, and it is also possible to stably produce the fabric having longitudinal elongation of 300% at most.

(Application to Work Clothes)

Figure 8:
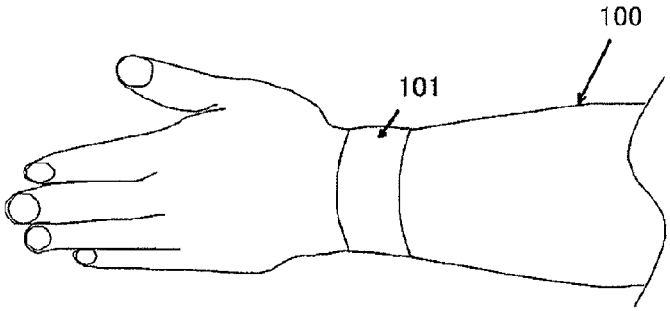
FIG. 8 is a diagram exemplifying a cuff portion of work clothes using the warp knitted fabric according to the embodiment of the present invention.

FIG. 8 is a diagram exemplifying a cuff portion 101 of work clothes 100 using the warp knitted fabric according to the embodiment of the present invention. The width of the cuff portion is approximately 50 to 100 mm. It is necessary to minimize space between the cuff portion and a wrist to prevent falling of body hair. When the conventional warp knitted fabric is used, the elongation range per unit power is small, and thus a wrist is oppressed. When the warp knitted fabric of the product of the present invention is used, the elongation range per unit power is wide, which achieves the structure excellent in wearing feeling without any oppression around the wrist (FIG. 8). According to the present invention, a single prescribed size can cover a peripheral length of a wrist or an ankle in a range of 1 to 2.5 times and the pressure on a body is small. This prevents falling of body hair and reduces pain due to oppression around a wrist or an ankle. Even when the strength of legs, a waist, and arms is weak, the work clothes are easy to wear and comfortable to wear.

The warp yarn 2 and the inserting yarn 3 may be yarn of a same material or yarn of different materials, diameters, or colors. Similarly, the weft yarn 4 and the inserting yarn 3 may be yarn of a same material or yarn of different materials, diameters, or colors. The positional relation between the inserting yarn 3 and the weft yarn 4 is not limited to the one in the embodiment. The warp knitting method is not limited to the one in the above-described example, and so-called Single Denbigh, Vandyke, and Single Cord can be applied. In this manner, it is clear that the present invention can be changed appropriately without departing from the scope of the present invention.

The invention claimed is:

1. A method of manufacturing a warp knitted fabric for forming warp knitted texture having higher longitudinal elongation, comprising:

arranging an active feed unit, which comprises a single follower roller arranged above two drive rollers on each of paths for a stretchable warp yarn and a stretchable inserting yarn to feed the warp yarn and the inserting yarn to a warp knitting machine while increasing an elongation thereof, so that the active feed unit feeds the warp yarn and the inserting yarn to the warp knitting machine while keeping feed amounts thereof constant; and knitting the inserting yarn in a warp direction and knitting weft yarn in a course direction while forming stitches with the warp yarn, thereby forming the warp knitted texture.

2. The method of manufacturing a warp knitted fabric according to claim 1, wherein the warp knitting machine is a crochet warp knitting machine, and a tension control unit for controlling tension applied on the warp yarn and the inserting yarn not to exceed upper limits thereof is arranged on an upstream side of the active feed unit so that the warp yarn and the inserting yarn are fed to the active feed unit while the tension control unit keeps the tension on the warp yarn and the inserting yarn in a certain range.

3. The method of manufacturing a warp knitted fabric according to claim 1, wherein the warp yarn and the inserting yarn are polyurethane elastic yarn, having the elongation of the warp yarn and the inserting yarn of 200% or higher but lower than 500%, and the elongation of the inserting yarn which is higher than the elongation of the warp yarn.

4. The method of manufacturing a warp knitted fabric according to claim 2, wherein the warp yarn and the inserting yarn are polyurethane elastic yarn, having the elongation of the warp yarn and the inserting yarn of 200% or higher but lower than 500%, and the elongation of the inserting yarn is higher than the elongation of the warp yarn.

5. The method of manufacturing a warp knitted fabric according to claim 1, further comprising, after the warp knitted texture is formed, performing water immersion, steam heating, washing, and drying, and then heating and thermally shrinking the knitted texture while pressing in the longitudinal direction with given intervals.

* * * * *